US008375866B2

(12) United States Patent
Heinzle et al.

(10) Patent No.: US 8,375,866 B2
(45) Date of Patent: Feb. 19, 2013

(54) SYSTEM FOR CONVEYING PERSONS

(75) Inventors: Florian Heinzle, Goetzis (AT); Peter Wilhelm, Frastanz (AT)

(73) Assignee: Innova Patent GmbH, Wolfurt (AT)

( * ) Notice: Subject to any disclaimer, the term of this patent is extended or adjusted under 35 U.S.C. 154(b) by 0 days.

(21) Appl. No.: 13/300,054

(22) Filed: Nov. 18, 2011

(65) Prior Publication Data

US 2012/0125222 A1 May 24, 2012

(30) Foreign Application Priority Data

Nov. 22, 2010 (AT) ..... 1930/2010

(51) Int. Cl.
*B61B 12/12* (2006.01)

(52) U.S. Cl. ..... 104/202; 104/204; 104/203; 104/178

(58) Field of Classification Search ..... 104/173.1, 104/173.2, 178, 202, 203, 204
See application file for complete search history.

(56) References Cited

U.S. PATENT DOCUMENTS

| | | | | |
|---|---|---|---|---|
| 3,610,164 | A * | 10/1971 | Feuz | 104/154 |
| 3,871,303 | A * | 3/1975 | Woodling | 104/173.1 |
| 4,092,929 | A * | 6/1978 | Laurent | 104/173.1 |
| 4,669,389 | A * | 6/1987 | Tarassoff | 104/173.2 |
| 5,406,891 | A * | 4/1995 | Kunczynski | 104/173.1 |
| 5,419,261 | A * | 5/1995 | Tarassoff et al. | 104/173.1 |
| 5,445,081 | A * | 8/1995 | Kunczynski | 104/165 |
| 5,465,668 | A * | 11/1995 | Tarassoff et al. | 104/95 |
| 5,517,923 | A * | 5/1996 | Cathiard | 104/173.1 |
| 2012/0125222 | A1 * | 5/2012 | Heinzle et al. | 104/202 |
| 2012/0125223 | A1 * | 5/2012 | Czaloun | 104/204 |

FOREIGN PATENT DOCUMENTS

| | | |
|---|---|---|
| EP | 0 611 220 A1 | 8/1994 |
| EP | 1 193 153 B1 | 12/2003 |

* cited by examiner

*Primary Examiner* — Jason C Smith
(74) *Attorney, Agent, or Firm* — Laurence A. Greenberg; Werner H. Stemer; Ralph E. Locher

(57) ABSTRACT

A system for conveying persons has a track along which a plurality of vehicles may be moved by way of continuous conveying cables. The cables include at least two mutually successive conveying cables each having a drive for driving them independently of one another. The vehicles may be coupled to the cables by clamping devices and the cables overlap one another in mutually associated end regions. The coupling of the vehicles may be transferred from a first conveying cable to a successive conveying cable in the overlap region. In those regions in which a first conveying cable is adjoined by a further conveying cable, that is, in the overlap region, at least one servo device is provided which allows the cable run of the further conveying cable to which the vehicle is to be coupled to be moved into the clamping device of the vehicle, while the clamping device is in the open position.

16 Claims, 24 Drawing Sheets

SYSTEM FOR CONVEYING PERSONS

CROSS-REFERENCE TO RELATED APPLICATION

This application claims the priority, under 35 U.S.C. §119, of Austrian patent application A 1930/2010, filed Nov. 22, 2010; the prior application is herewith incorporated by reference in its entirety.

BACKGROUND OF THE INVENTION

Field of the Invention

The present invention relates to a system for conveying persons, having at least one track along which a plurality of vehicles may be moved by means of a plurality of continuous conveying cables, wherein at least two mutually successive conveying cables are provided in each direction of travel, with each of which at least one drive is associated, as a result of which they may be driven independently of one another, and to which the vehicles may be coupled by means of clamping devices and which overlap one another in the mutually associated end regions, as a result of which coupling of the vehicles may be transferred from a first conveying cable to the successive conveying cable.

Prior systems of the generic kind for conveying persons are described, for example, in U.S. Pat. No. 5,419,261 and its counterpart European patent EP 0 611 220 B1 and in European patent EP 1 193 153 B1. Those systems have two tracks along which vehicles may be moved by way of continuous conveying cables with which drives are associated. Because the vehicles are coupled to the conveying cables associated therewith, movement of the vehicles is controlled by the drives of the conveying cables. Because these conveying cables are limited in length, it is further known to provide, in each of the two directions of travel and mutually successively, at least two conveying cables. This makes it possible on the one hand to construct such systems for conveying persons to have any desired length. Because the vehicles are coupled to the individual conveying cables, on the other hand this also makes it possible to control the movement of the individual vehicles independently of one another. Stopping the drives of the conveying cables brings the vehicles coupled to these conveying cables to a standstill, whereupon the passengers can disembark and embark on the vehicles.

In the case of prior art systems of this kind, it is necessary to uncouple each of the vehicles from a conveying cable at the end thereof which is in the direction of movement and to couple them to the successive conveying cable. To make this possible, it is known to arrange the end regions of the two conveying cables next to one another and furthermore to construct the at least one coupling device that is provided on the vehicles to be movable transversely to the direction of movement of the vehicles. As soon as the vehicles reach the end of the first conveying cable, they are uncoupled from the first conveying cable, the clamping device provided on these vehicles is furthermore moved transversely to the course of the two conveying cables and the vehicles are coupled to the next conveying cables, as a result of which, as the procedure continues, they are moved by this conveying cable.

The prior art systems for conveying persons are disadvantageous in that the individual vehicles each have to be constructed to have a device for moving the coupling device. These assemblies require maintenance and they increase the weight of the vehicles.

SUMMARY OF THE INVENTION

It is accordingly an object of the invention to provide a system for transporting persons which overcomes the above-mentioned disadvantages of the heretofore-known devices and methods of this general type.

With the foregoing and other objects in view there is provided, in accordance with the invention, a system for conveying persons, comprising:

at least one track and a plurality of vehicles to be supported on the at least one track;

a plurality of continuous conveying cables for driving the vehicles along the at least one track, the conveying cables including a first conveying cable and at least one successive conveying cable disposed successively to the first conveying cable and with an overlap region therebetween;

at least one drive associated with each of the successive conveying cables for independently driving each of the conveying cables;

the vehicles each carrying clamping devices configured for clamping the vehicles to respective the conveying cables;

the cables having cable run s overlapping one another in mutually associated end regions thereof to form the overlap region, enabling a coupling of a respective the vehicle to be transferred from the first conveying cable to a successive the conveying cable; and at least one servo device disposed in the overlap region at which the first conveying cable and the successive conveying cable overlap one another, and configured to move the cable run of the successive conveying cable into the clamping device of a vehicle to be coupled, while the clamping device is in an open position.

In other words, the objects of the invention are achieved in that there is provided, in those regions in which a conveying cable is adjoined by a further conveying cable, at least one servo device which enables the cable run of the further conveying cable to which the vehicle is to be coupled to be moved into the clamping device of this vehicle, which is in the open position.

Preferably, the vehicles are constructed to have at least one clamping device which has two clamping jaws that may be moved into their open position by means of a servo cylinder in opposition to the action of a servo spring.

According to a first embodiment, the servo device may have at least one servo roll or the like by means of which the cable run of the further conveying cable to which the vehicle is to be coupled may be moved in the horizontal direction and, furthermore, may have at least one servo roll or the like by means of which this cable run of the further conveying cable may be moved in the vertical direction. Preferably, the servo device for moving cable runs horizontally has at least one pair of servo rolls or the like, by means of which a respective one of the two cable runs of two conveying cables which are located next to one another may be moved in the horizontal direction, and the servo device for moving cable runs vertically has at least one servo roll or the like, by means of which a respective one of the two cable runs of two conveying cables which are located next to one another may be moved in the vertical direction. Here, the servo device for moving cable runs horizontally may have a plurality of pairs of servo rolls or the like which are located spaced from one another in the longitudinal direction of the system, by means of which a respective one of the two cable runs of two conveying cables which are located next to one another may be moved in the horizontal direction, and the servo device for moving cable runs vertically may have a plurality of servo rolls or the like which are located spaced from one another in the longitudinal direction of the system, by means of which one of the two cable runs of two conveying cables which are located next to one another may be moved in the vertical direction. Here, the servo rolls or the like which are located spaced from one another for moving the cable runs vertically may be movable together by means of a servo rod which extends in the longitudinal direction of the system. Here, furthermore, the servo rolls or the like for moving one of the cable runs in the horizontal or vertical direction may be movable by at least one hydraulic or pneumatic servo cylinder or an electric servo motor.

Here, the cable runs are moved in the at least approximately horizontal direction or the at least approximately vertical direction.

According to a second embodiment, the servo device is formed by a servo frame which is movable in translational motion by means of a servo cylinder or an electric servo motor and which is constructed to have two receiving faces for a respective one of two cable runs which are located next to one another, these receiving faces being able to grasp one of the two cable runs and move it into the clamping device, which is in its open position. Preferably, here, the piston rod of a servo cylinder or the servo motor is articulated to the servo frame, and the servo frame is articulated to two rotatably mounted pivotal arms. Furthermore, the servo frame is preferably constructed to have two prolonged portions which project toward the cable runs and are constructed to have a respective shoulder on the mutually facing sides, these shoulders being able to grasp a respective cable run and move it into the clamping device, which is in its open position.

According to a third embodiment, the servo device is formed by two servo rolls or the like which are guided in slideways by means of a servo cylinder or an electric servo motor, wherein the movement thereof allows one of the two cable runs to be grasped and moved into the clamping device, which is in its open position. Preferably, here, the servo rolls or the like are moved by means of a respective servo lever, which is articulated to a rotatably mounted angled lever, wherein a common servo lever, to which the piston rod of the servo cylinder or the electric servo motor is articulated, is associated with the two angled levers. Furthermore, the two angled levers may preferably each be pivoted clockwise and counterclockwise by the servo cylinder or the electric servo motor, wherein one of the two servo rolls or the like may be moved toward the associated cable run or away therefrom.

In the case of these two further embodiments, it is possible for servo devices located spaced from one another in the longitudinal direction of the system to be connected mechanically to one another for movement together.

Other features which are considered as characteristic for the invention are set forth in the appended claims.

Although the invention is illustrated and described herein as embodied in a system for conveying persons, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
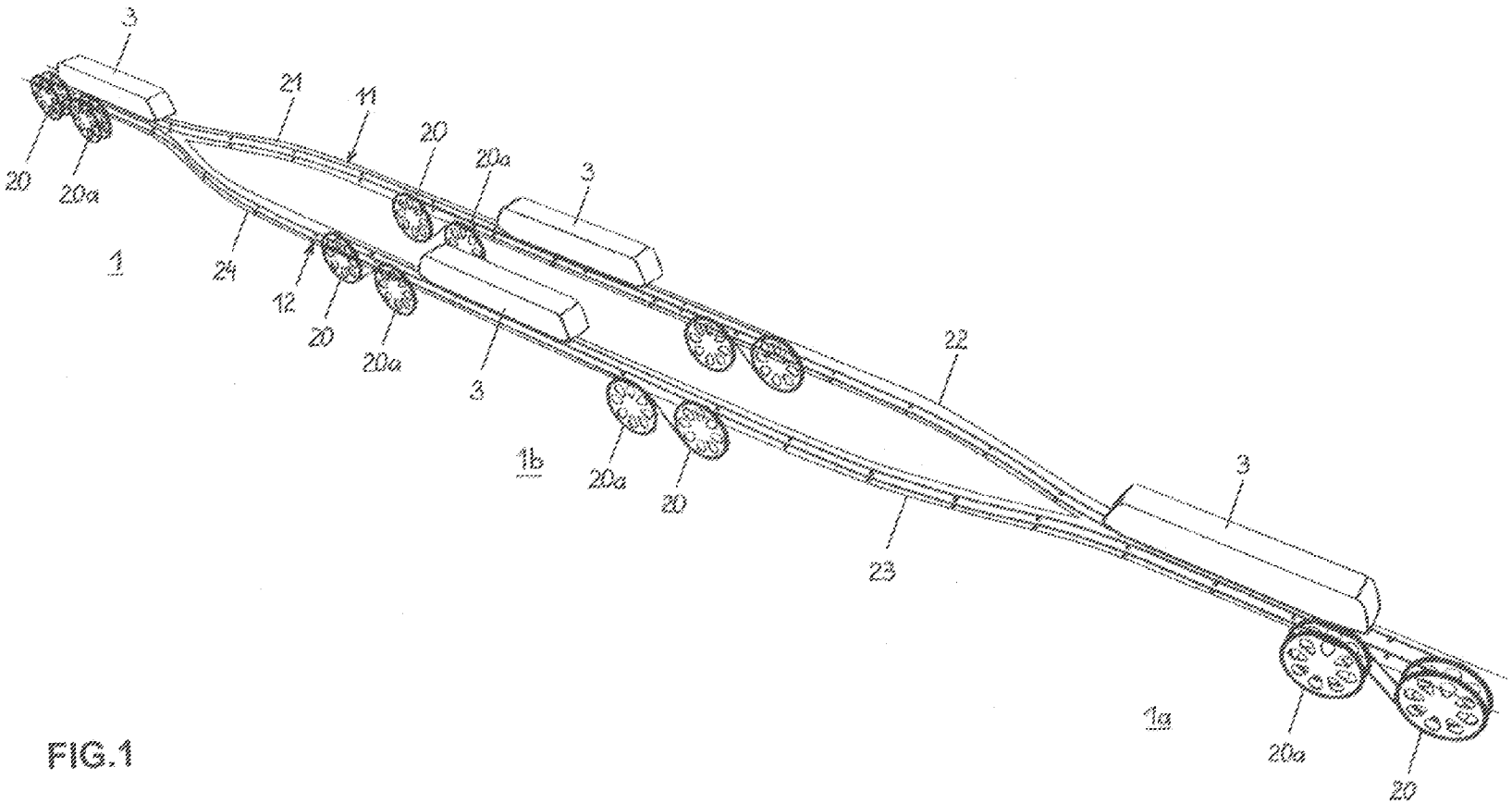
FIG. 1 and FIG. 1A show a system according to the invention for conveying persons, in perspective illustration and in plan view.
Figure 1A:
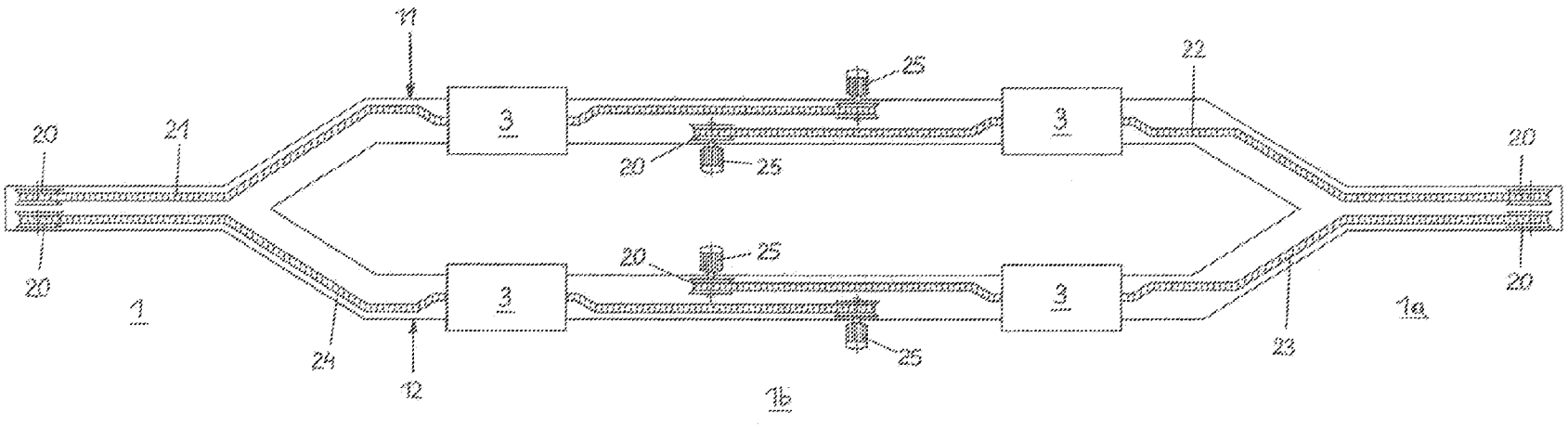

Referring now to the figures of the drawing in detail and first, particularly, to FIGS. 1 and 1A thereof, there is shown a system for conveying persons with two terminal stations 1 and 1*a* between which two approximately parallel tracks 11 and 12 are located, along which four vehicles 3 are moved by way of four conveying cables 21, 22, 23 and 24. A first conveying cable 21 proceeds from the end station 1, leads to a middle station 1*b* and is adjoined by a second conveying cable 22, which extends toward the second end station 1*a*. Approximately parallel thereto there runs a third conveying cable 23, which proceeds from the second end station 1*a*, similarly extends to the middle station 1*b* and is adjoined by a fourth conveying cable 24, which leads to the first end station 1. The conveying cables 21, 22, 23 and 24 are guided at their ends by way of return pulleys 20 and deflection pulleys 20*a* which are borne on axes that are aligned approximately parallel. A drive motor 25 is associated with at least one of the return pulleys 20 of each of the conveying cables. The vehicles 3 may be coupled to the respectively upper cable runs of the conveying cables 21 to 24.

This system is operated in that a vehicle 3 is moved along the track 11 from the first end station 1 to the middle station 1*b* by means of the conveying cable 21. As the procedure continues further, this vehicle 3 is coupled to the second conveying cable 22, which moves it to the second end station 1*a*. As the procedure continues, this vehicle 3 is moved along the track 12 from the second end station 1*a* to the middle station 1*b* and from that to the first end station 1. Similarly, the other vehicles 3 are also moved along the track 11 between the end stations 1 and 1*a* and the middle station 1*b* by means of the conveying cables 21 and 22 in a first direction, and along the track 12 by means of the conveying cables 23 and 24 in the opposite direction. Since the individual vehicles 3 are in each case coupled only to one of the conveying cables 21 to 24, they are moved individually by the drives 25 for the conveying cables 21 to 24. Thus, they are stopped if the respectively associated drives 25 are stopped, whereupon passengers can get on or off.

Because any desired number of conveying cables, to which in each case a vehicle 3 or a group of vehicles may be coupled, is provided mutually successively on each section, it is possible to provide in the system on the one hand a number of vehicles 3 or groups of vehicles that corresponds to the number of conveying cables and the system may have any desired length.

In the case of known systems of this kind for conveying persons, coupling of the vehicles is transferred from one conveying cable to a successive conveying cable in that the mutually associated end regions of the conveying cables are located next to one another and the respective clamping device that is provided on the vehicles may be moved transversely to the course of the conveying cables. Here, coupling is transferred from one conveying cable to the successive conveying cable by uncoupling the vehicle concerned from a conveying cable by opening the clamping device, thereupon moving the clamping device such that it reaches the further conveying cable, and thereupon putting the clamping device in its closed position, as a result of which this vehicle is coupled to the further conveying cable. Thus, for operation of a system of this kind it is necessary for each of the vehicles to be constructed to have a movable clamping device.

By contrast, in a system according to the invention for conveying persons, servo devices are provided for the runs of the conveying cables, as a result of which in the coupling regions the conveying cables are guided into the clamping devices located on the vehicles, which are in their open position. Thus, there is no necessity for the coupling clamps to be constructed such that they are movable transversely to the direction of movement of the vehicles.

Figure 2:
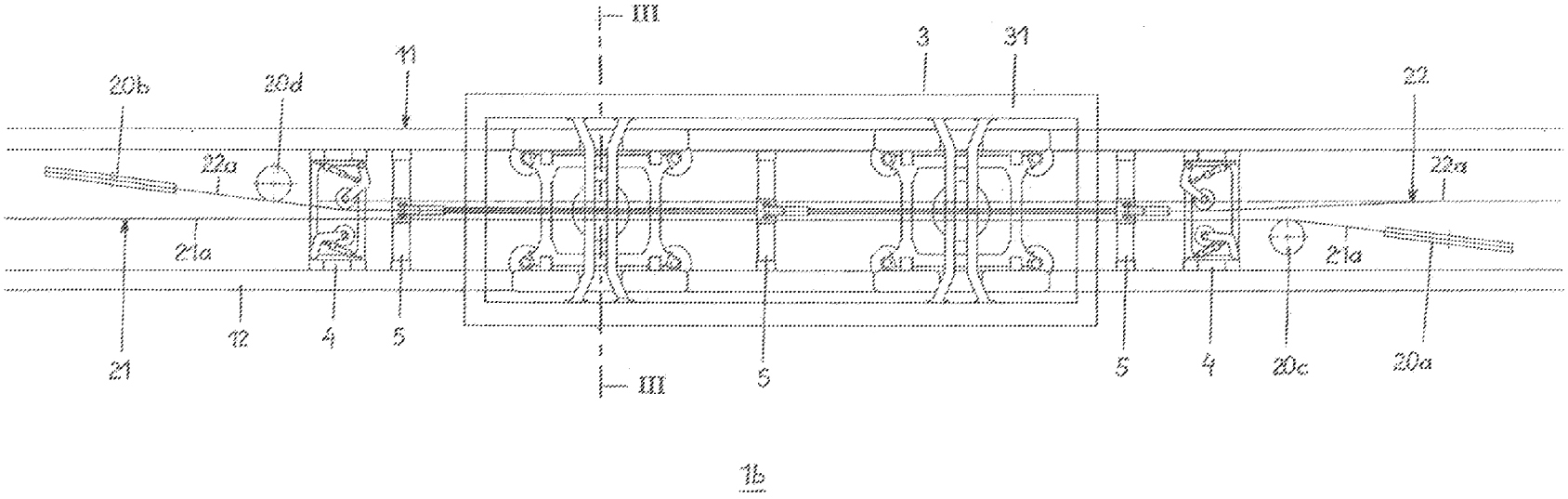
FIG. 2 shows a first embodiment of a servo device for the conveying cables, in plan view.

FIG. 2 illustrates one of the portions of the system according to the invention for conveying persons in which coupling of the vehicles 3 is transferred from one conveying cable to another conveying cable. Located in this portion are the end region of the first conveying cable 21, which is guided over a return roll 20*c* and a return pulley 20*a*, and the end region of the second conveying cable 22, which is guided over a return roll 20*d* and a return pulley 20*b*. Between the two return pulleys 20*a* and 20*b* there are located at least two devices 4 for moving the respectively upper runs 21*a* and 22*a* of the conveying cables 21 and 22 in the horizontal direction. In addition, there are located in this portion three devices 5 for moving the respectively upper runs 21*a* and 22*a* of the conveying cables 21 and 22 in the vertical direction. On the underside of the vehicle bogies 31 there are located four clamping devices by means of which the vehicles 3 may be coupled to one of the conveying cables 21 and 22.

Figure 2A:
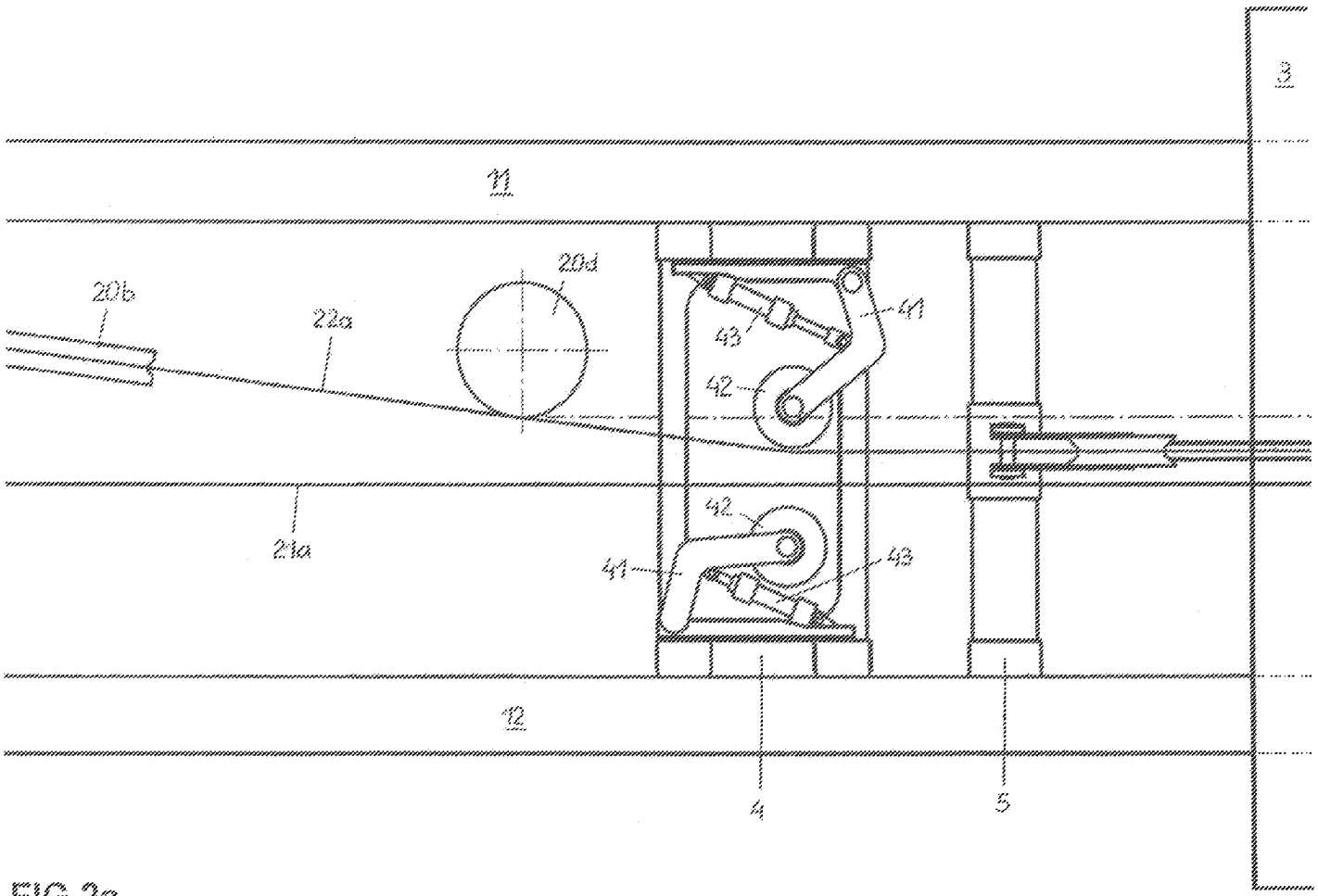
FIG. 2A and FIG. 2B show details of FIG. 2, on a larger scale than FIG. 2, FIG. 2C and FIG. 2D show a further detail of FIG. 2, on a larger scale than FIG. 2.
Figure 2B:
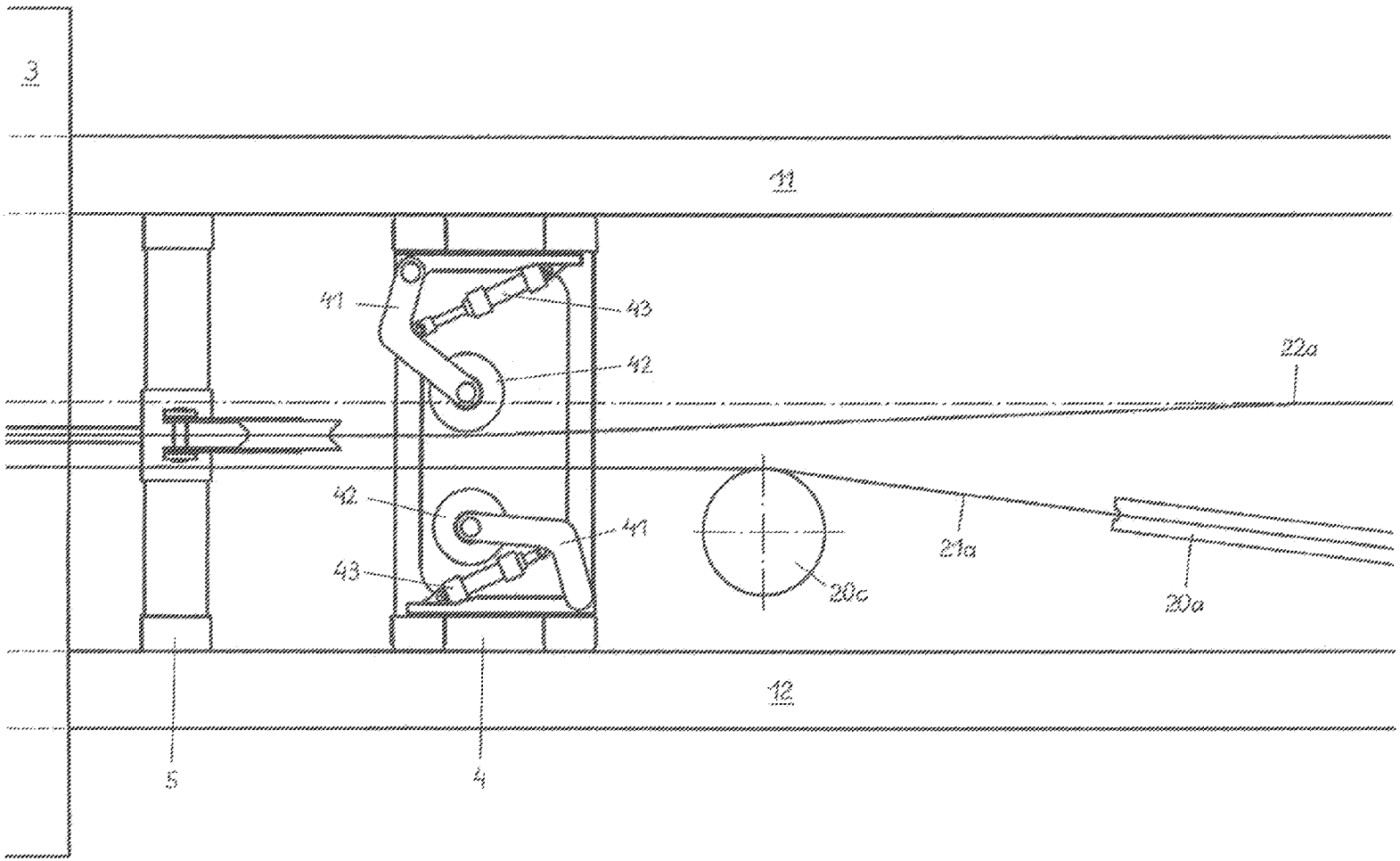

As can be seen from FIG. 2A and FIG. 2B, the devices 4 for moving the upper runs 21*a* and 22*a* of the conveying cables 21 and 22 each have two servo levers 41 which are associated with these runs 21*a* and 22*a* and at the free ends whereof a respective servo roll 42 is mounted, the latter being pivotal by means of a hydraulic or pneumatic servo cylinder 43 toward the cable runs 21*a* and 22*a* respectively, as a result of which either the cable run 21*a* or the cable run 22*a* is movable in the horizontal direction. In these illustrations, the cable run 22*a* has been moved by the servo rolls 42 associated therewith out of the position of the dot-and-dash line and into a central position in relation to the vehicle 3, as a result of which it is located below clamping devices arranged on the vehicles 3.

Similarly, the cable run 21*a* may be moved into this central position by means of the respectively other servo rolls 42.

Figure 2C:
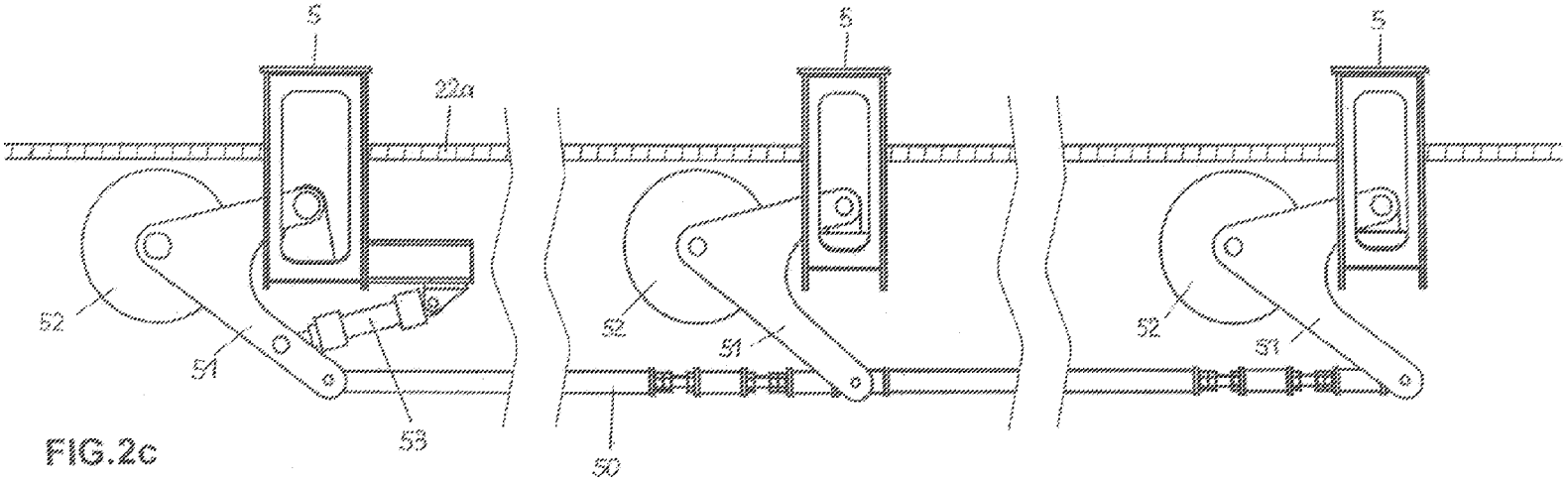
Figure 2D:
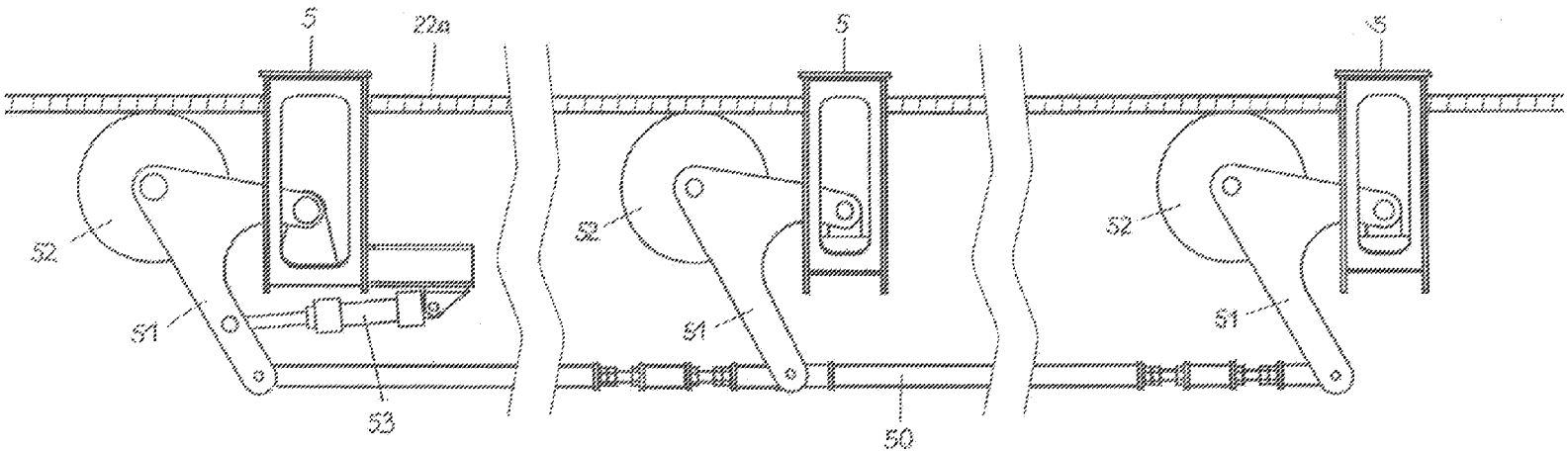

As can be seen from FIG. 2C and FIG. 2D, the devices 5 for vertical movement of a cable run, in the present case the cable run 22*a*, each have a servo lever 51 on which a servo roll 52 is mounted, the latter being movable by means of a hydraulic or pneumatic servo cylinder 53 to a heightwise position such that the cable run comes into the clamping device provided on the vehicle 3, which is in its open position. The devices 5, which are spaced from one another in the longitudinal direction of the system, for heightwise movement of the cable runs are articulated to a common servo rod 50.

FIG. 2C shows the starting position of the servo rolls 52. FIG. 2D shows the position of the servo rolls 52 in which the cable run 22*a* has been moved upward. Instead of the servo cylinders 43 and 53, electric servo motors may be provided.

The cable runs are moved in at least approximately the horizontal or at least approximately the vertical direction.

Figure 3:
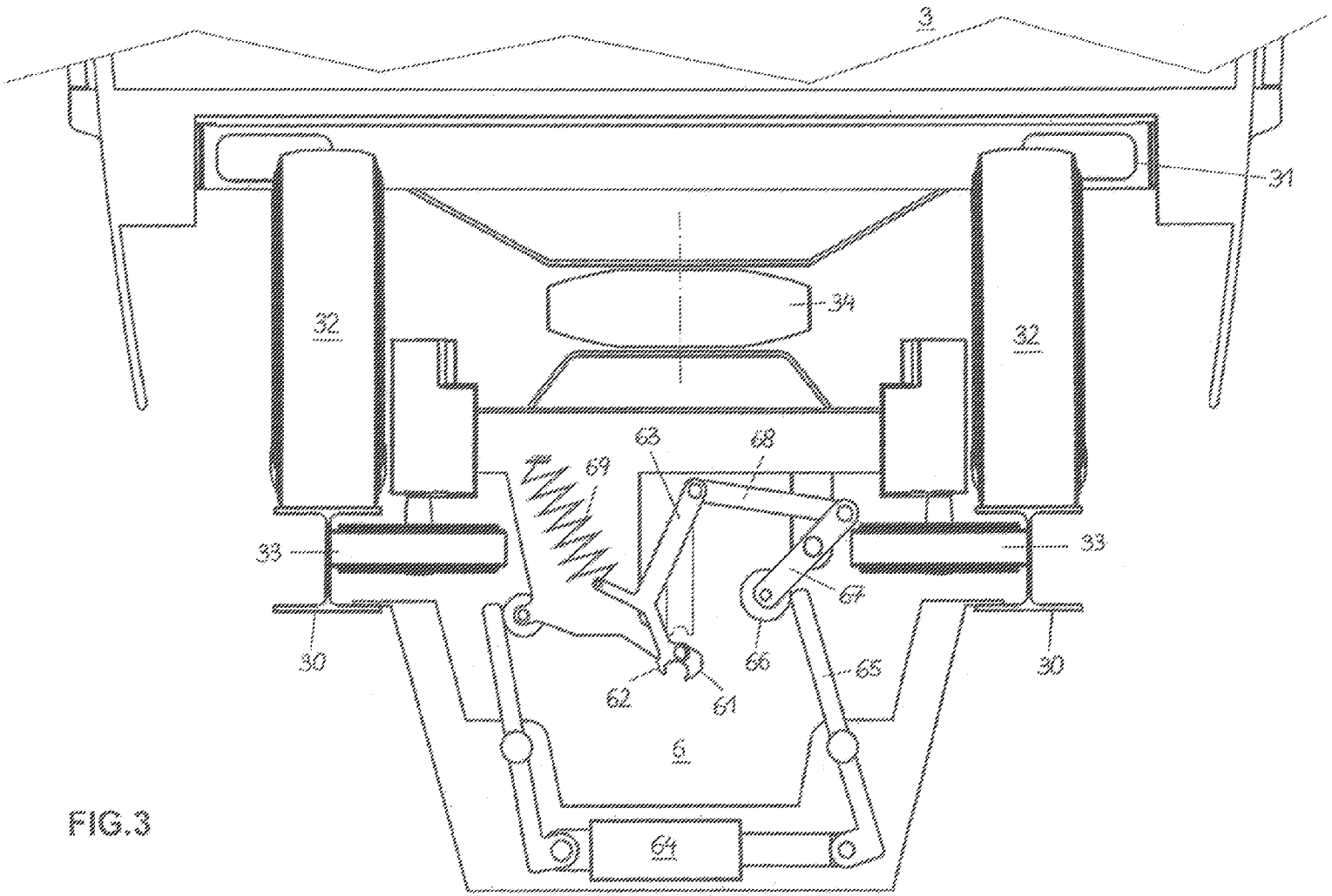
FIG. 3 shows a section along the line III-III in FIG. 2, on a larger scale than FIG. 2, and FIG. 3A, FIG. 3B, FIG. 3C, FIG. 3D and FIG. 3E show illustrations corresponding to FIG. 3 to illustrate the mutually successive phases of the coupling procedure.

As can be seen from FIG. 3, the vehicles 3 have vehicle bogies 31 on which vehicle tires 32 and guide rolls 33 are mounted, by means of which the vehicle 3 may be moved along rails 30. Furthermore, shock-absorbing elements 34 are provided in the vehicle bogie 31. On the underside of the vehicle bogie 31 there are four clamping devices 6, which are actuated in the regions in which transfer of the coupling of the vehicles 3 is performed.

Each clamping device 6 has a clamping jaw 61 that is fixed to the bogie and a clamping jaw 62 that is movable. The movable clamping jaw 62, which is located on a servo lever 63, is moved into its open position by a fixed hydraulic or pneumatic servo cylinder 64 by way of a servo lever 65, a servo roll 66 and two servo arms 67 and 68, in opposition to the action of a pressure spring 69 which puts the clamping jaws 61, 62 into their closed position.

Instead of the servo cylinder 64, an electric servo motor may be provided.

Figure 3A:
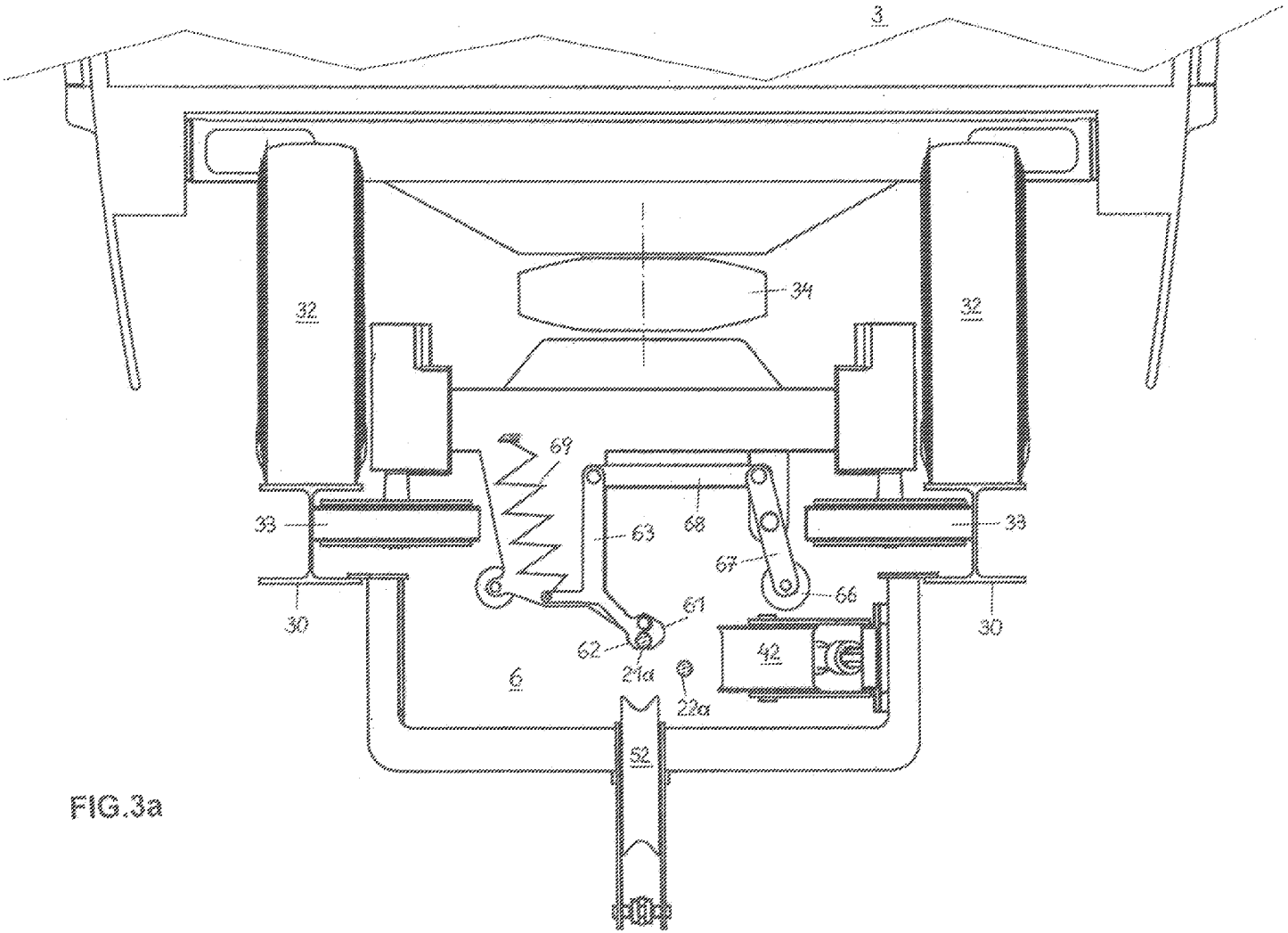

The coupling procedure is explained below with reference to FIG. 3A, FIG. 3B, FIG. 3C, FIG. 3D and FIG. 3E:

In FIG. 3A, a vehicle 3 is coupled to the cable run 21*a*, as a result of which it may be moved along the rails 30, by means of the clamping jaws 61 and 62 located thereon, which are in their closed position under the action of the pressure spring 69.

Figure 3B:
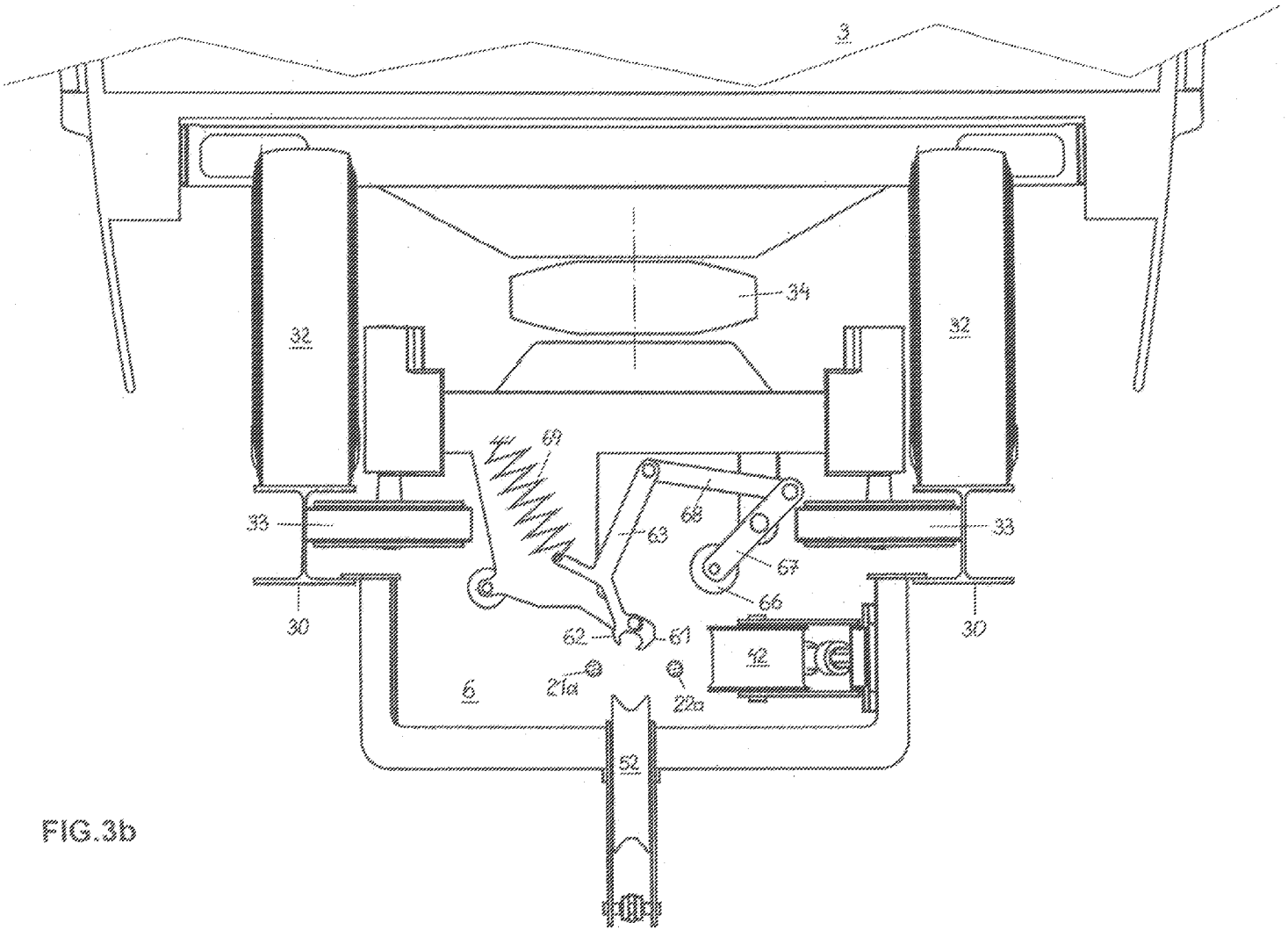

In FIG. 3B, the clamping jaws 61 and 62 have been opened by means of the servo cylinder 64, in opposition to the action of the pressure spring 69, as a result of which the cable run 21*a* has come out of the clamping jaws 61 and 62 and the vehicle 3 has been uncoupled from the cable run 21*a*.

Figure 3C:
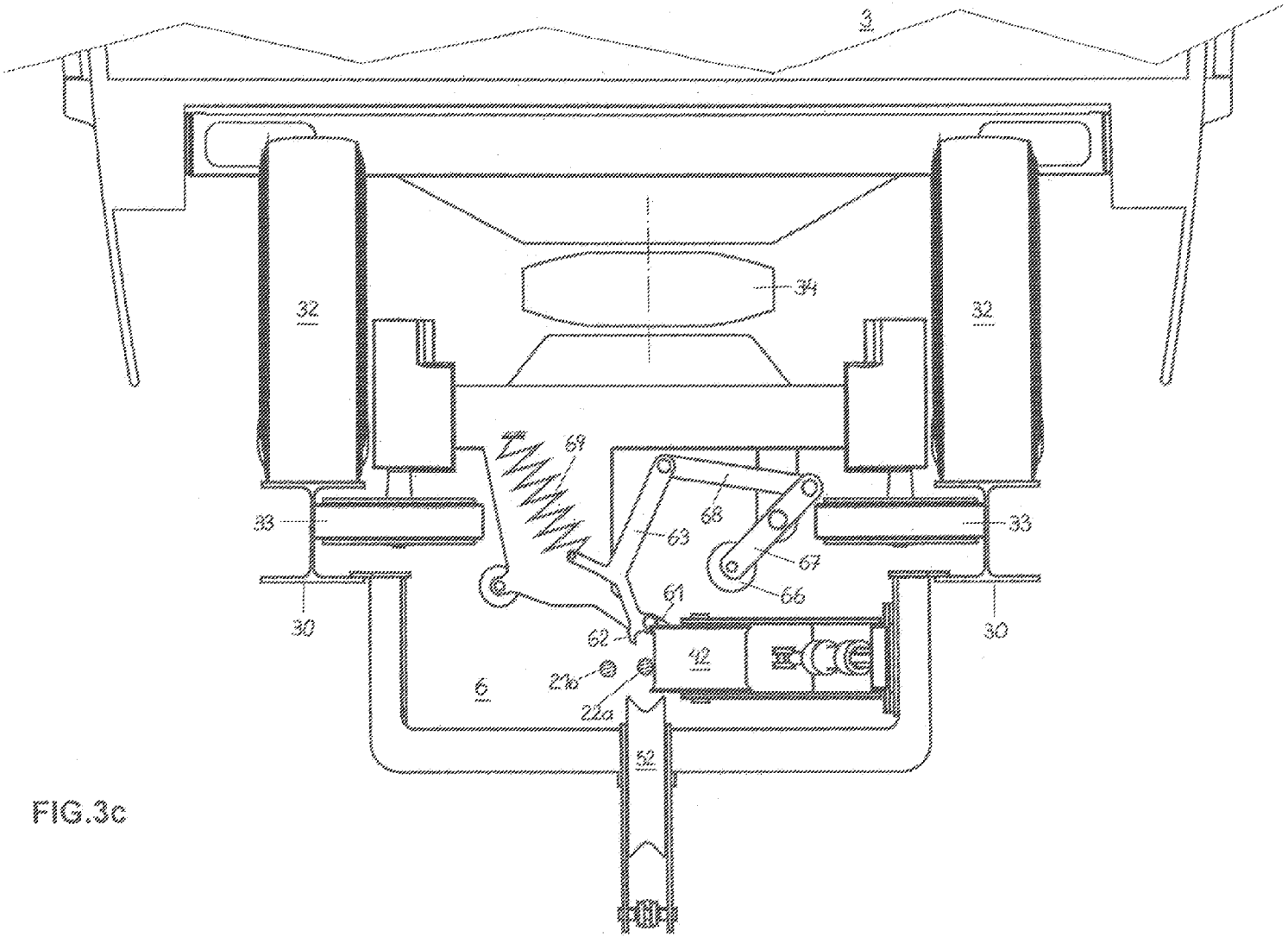

In order to couple the vehicle 3 to the upper cable run 22*a* of the second conveying cable 22, as can be seen in FIG. 3C, the servo rolls 42 which may be moved in the horizontal direction are moved toward the cable run 22*a*, as a result of which the latter moves into a position below the opened clamping jaws 61 and 62.

Figure 3D:
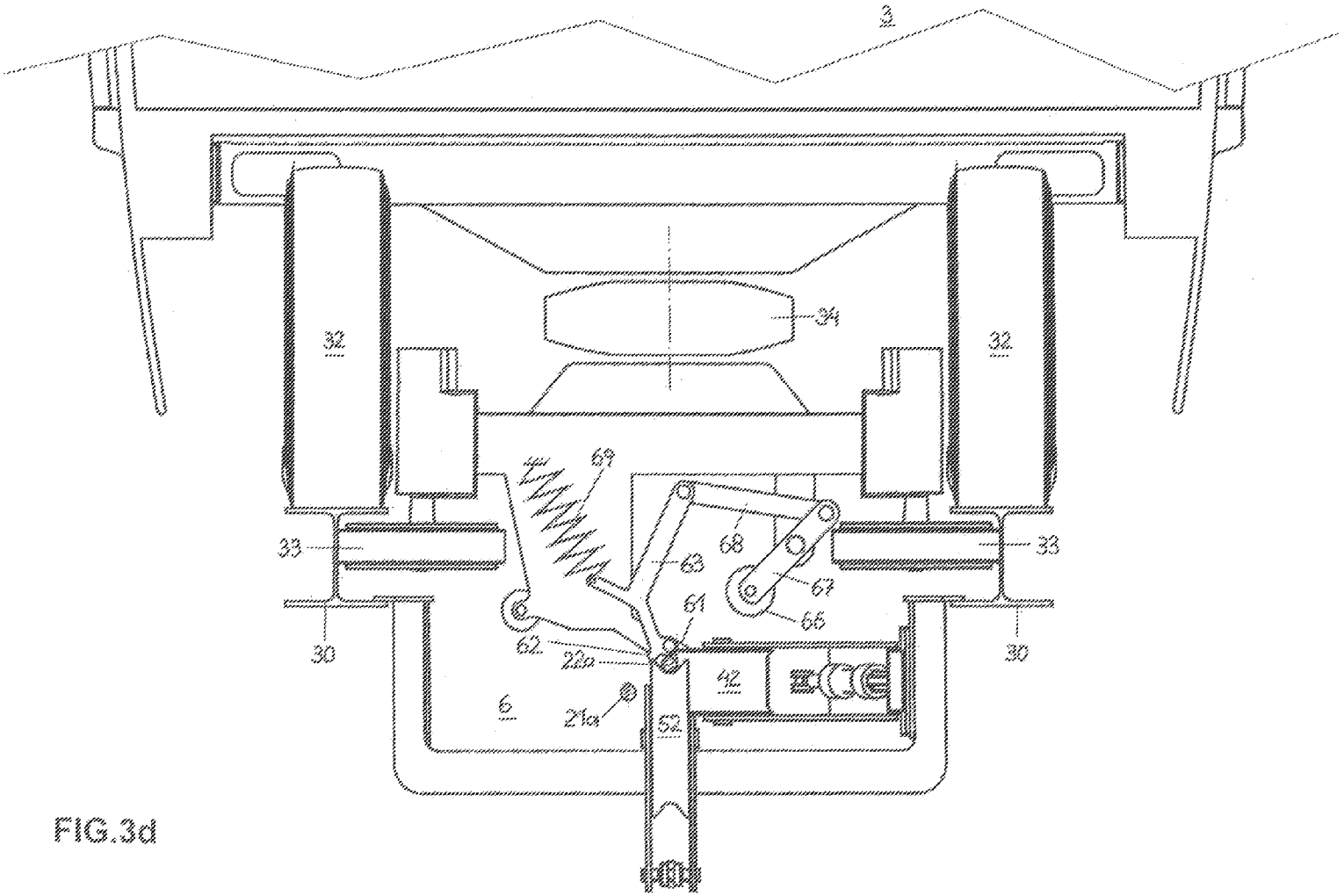

As can be seen from FIG. 3D, as the procedure continues the servo rolls 52 are moved upward, as a result of which the cable run 22*a* comes between the clamping jaws 61 and 62, which are in their open position.

Figure 3E:
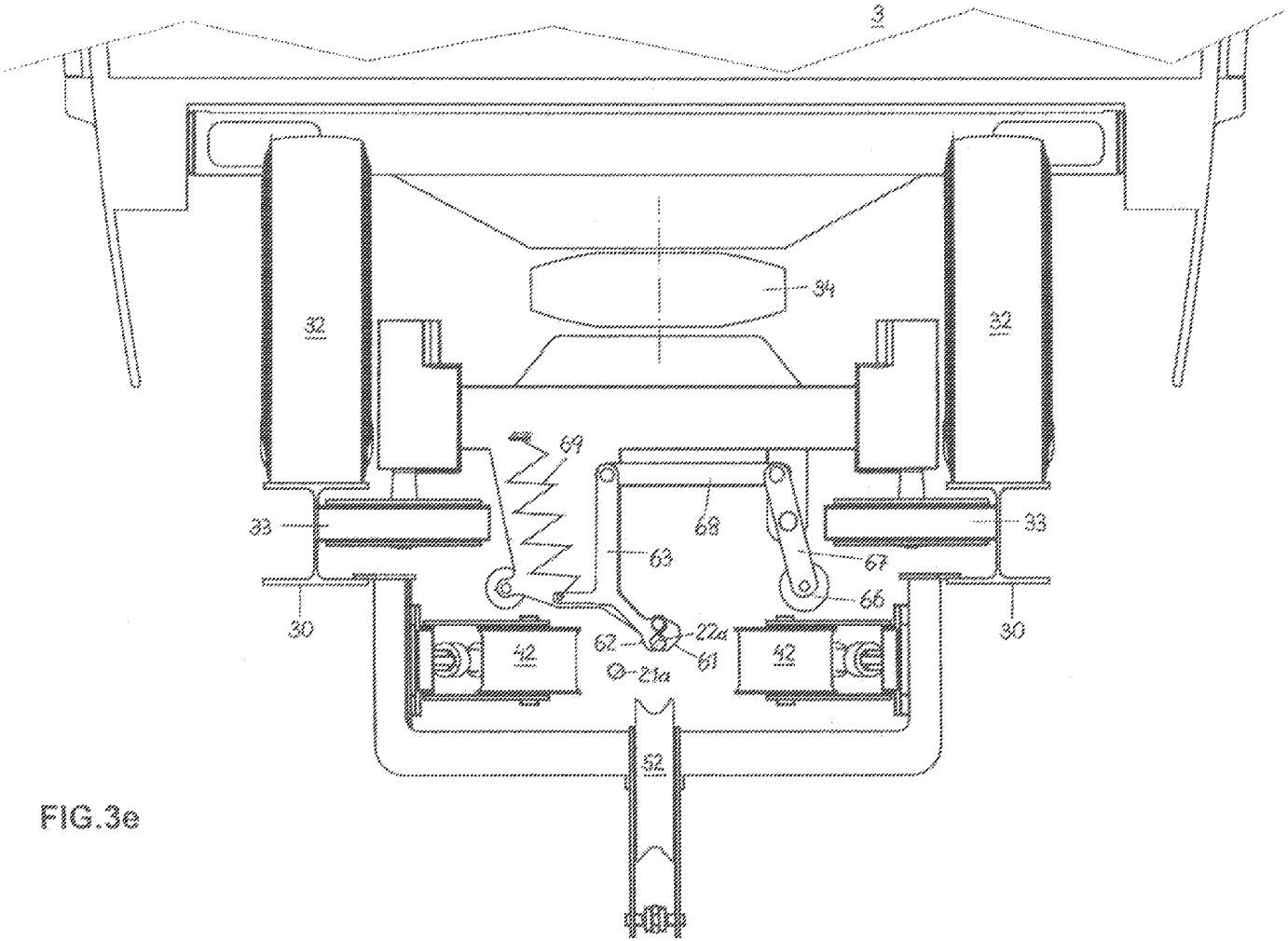

As soon as the servo cylinder 64 has been operated such that the clamping jaws 61 and 62 have been put back into their closed position by the pressure spring 69, and furthermore the servo rolls 42 and 52 have been moved back into their starting position, as illustrated in FIG. 3E, the vehicle 3 is coupled to the upper cable run 22*a* of the conveying cable 22, as a result of which it may be moved from there to the next station.

A further embodiment of a servo device is explained below with reference to FIG. 4 to FIG. 4E.

This servo device comprises a servo frame 71 that is articulated to two pivotal levers 72 and 72*a*, which are provided on rotatably mounted tubular pieces 70 and 70*a*, this servo frame 71 being capable of being moved in translational motion by means of a hydraulic or pneumatic servo cylinder 73 whereof the piston rod 73*a* is articulated to the servo frame 71. The servo frame 71 is constructed to have two prolonged portions 74 and 75 which project toward the clamping device 6 and are constructed to have shoulders 74*a* and 75*a* on mutually facing side faces. These shoulders 74*a* and 75*a* serve to grasp one of the two cable runs 21*a* and 22*a* and guide it into the clamping jaws 61 and 62, which are in their open position. In this embodiment too, the clamping device 6 is operated by means of the servo cylinder 64 which is illustrated in FIG. 3, by way of the servo lever 65, the servo arms 67 and 68 and the servo lever 63.

Instead of the servo cylinder 73, an electric servo motor may be provided.

Figure 4:
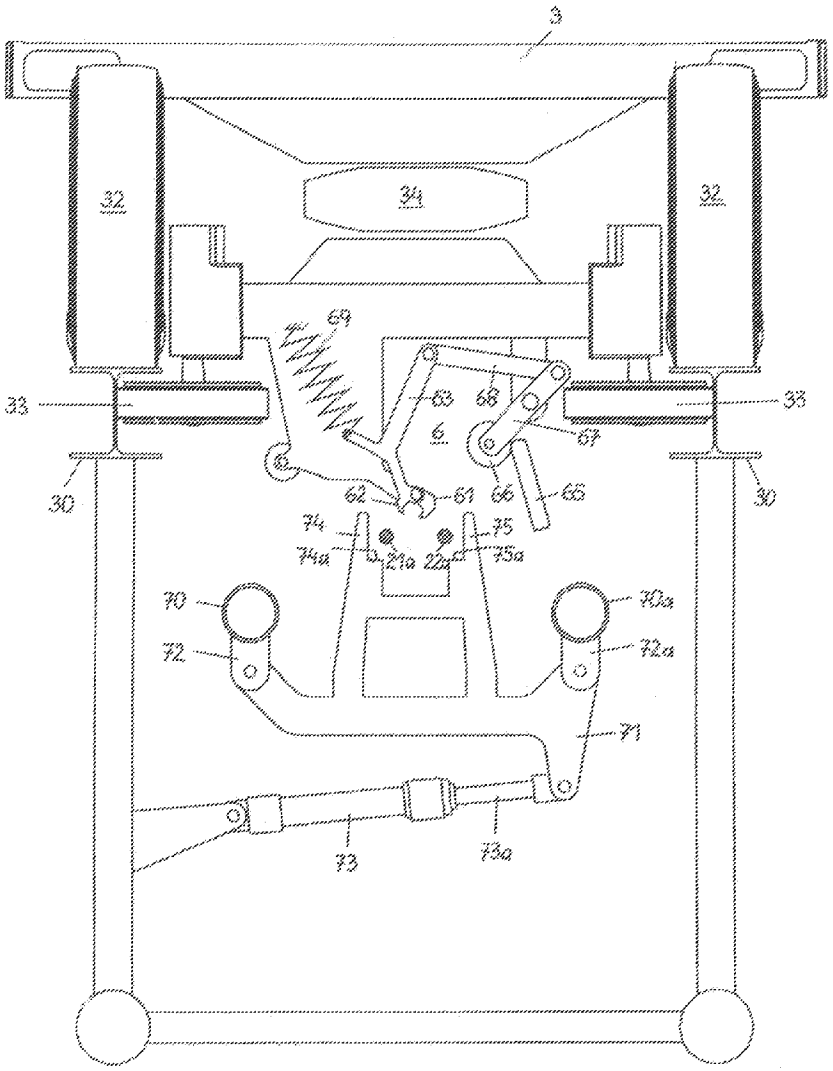
FIG. 4, FIG. 4A, FIG. 4B, FIG. 4C, FIG. 4D and FIG. 4E show a second embodiment of the device for moving the cable runs, in side view and in different phases of the coupling procedure.

FIG. 4 illustrates the position in which the clamping device 6 is not coupled to either of the two cable runs 21*a* and 22*a*, as a result of which the vehicle 3 is uncoupled.

Figure 4A:
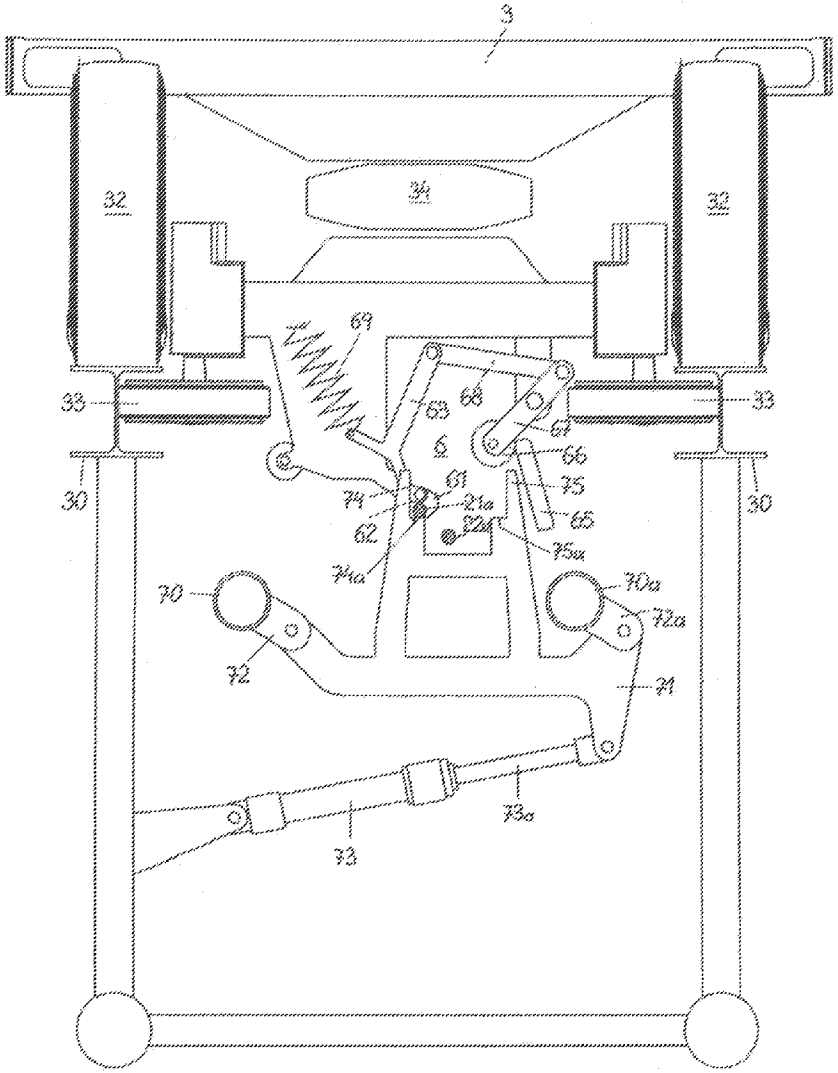

In FIG. 4A, the servo frame 71 has been moved by means of the servo cylinder 73 and piston rod 73*a* such that the cable run 21*a* has come up against the shoulder 74*a* and is moved by the latter into the clamping jaws 61 and 62, which are in their open position.

Figure 4B:
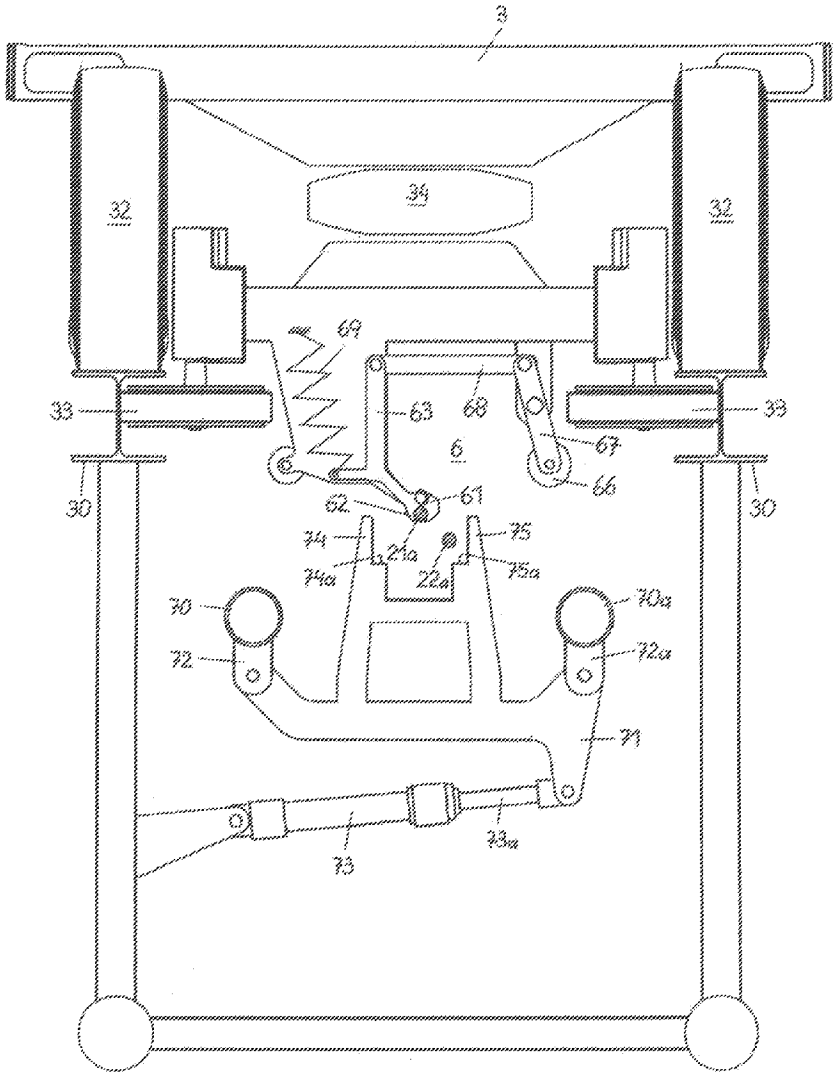

As can be seen from FIG. 4B, thereupon the servo cylinder 64 is operated such that the clamping device 6 is moved under the action of the pressure spring 69 into its closed position, as a result of which the vehicle 3 is coupled to the cable run 21*a*, and the servo frame 71 is moved back into its central position.

Figure 4C:
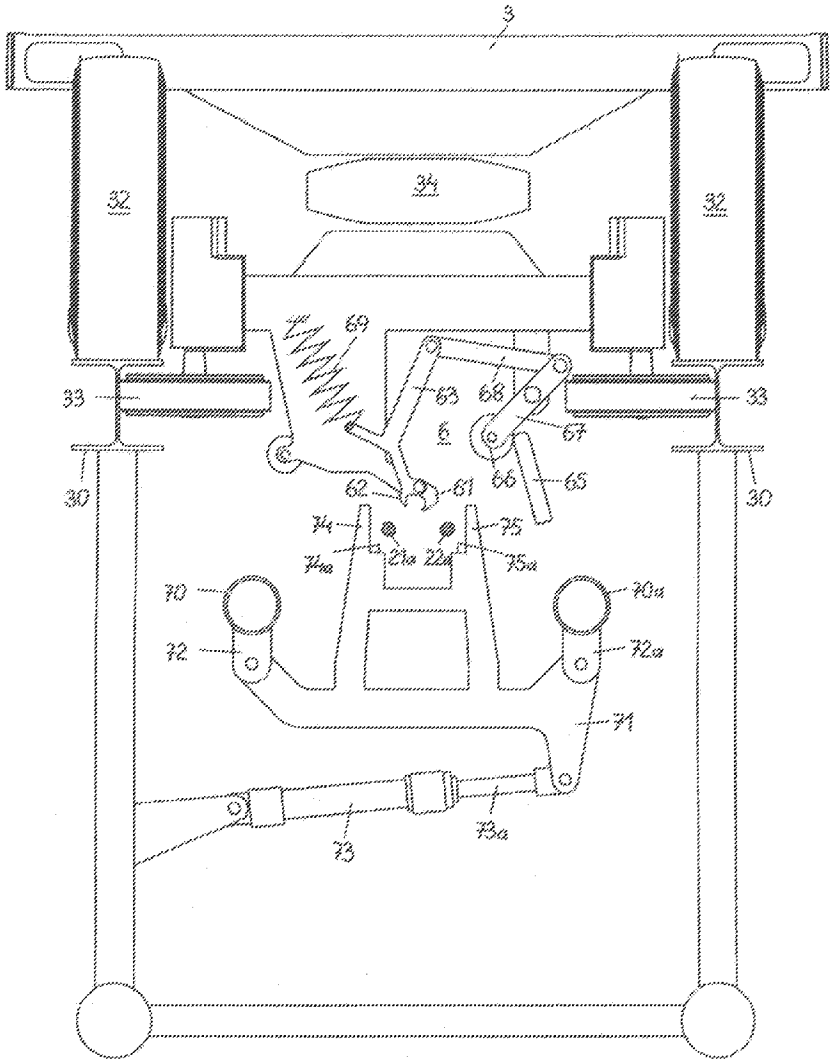

FIG. 4C furthermore illustrates the clamping device 6 moved into its open position, as a result of which the vehicle 3 is uncoupled from the conveying cable 21*a* again.

Figure 4D:
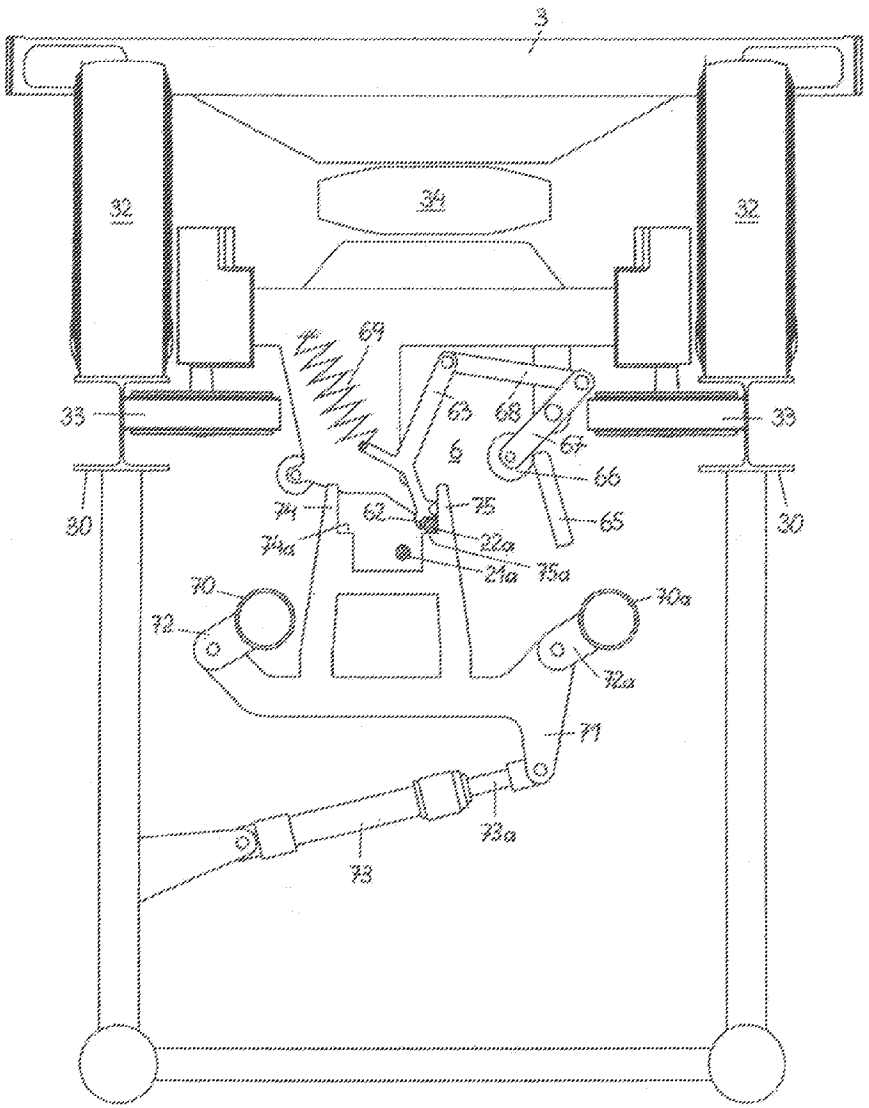
Figure 4E:
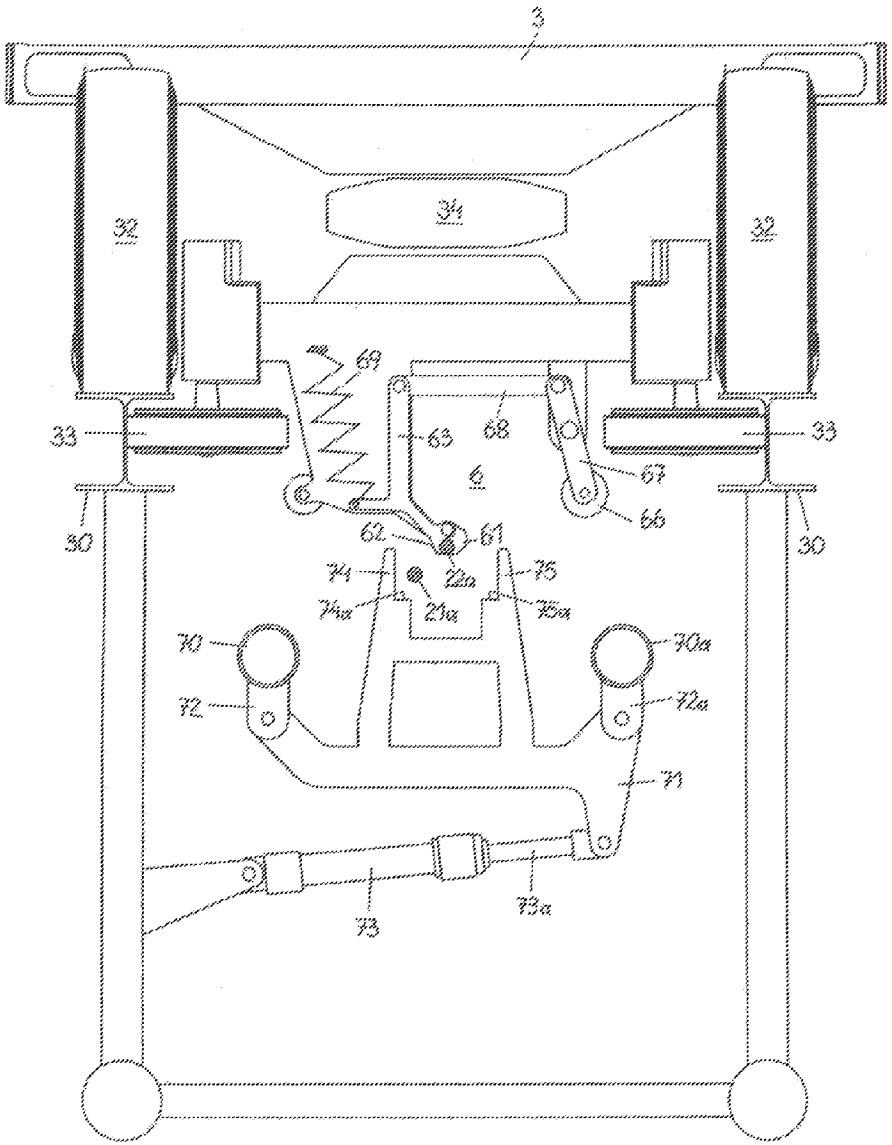

As can be seen from FIG. 4D, it is furthermore possible for the servo frame 71 to be moved by means of the servo cylinder 73 and the piston rod 73*a* such that the cable run 22*a* is grasped by the shoulder 75*a* and furthermore moved into the clamping jaws 61 and 62, which are located in the open position. Thereupon, the clamping device 6 is put into its closed position, as a result of which the vehicle 3 is coupled to the cable run 22*a*, and the servo frame 71 is moved back into its central position, as illustrated in FIG. 4E.

Where a plurality of servo devices, spaced from one another in the longitudinal direction of the system, are connected to one another by way of at least one of the tubular pieces 70 and 70*a*, all the servo frames 71 may be moved by means of a single servo cylinder 73.

Figure 5:
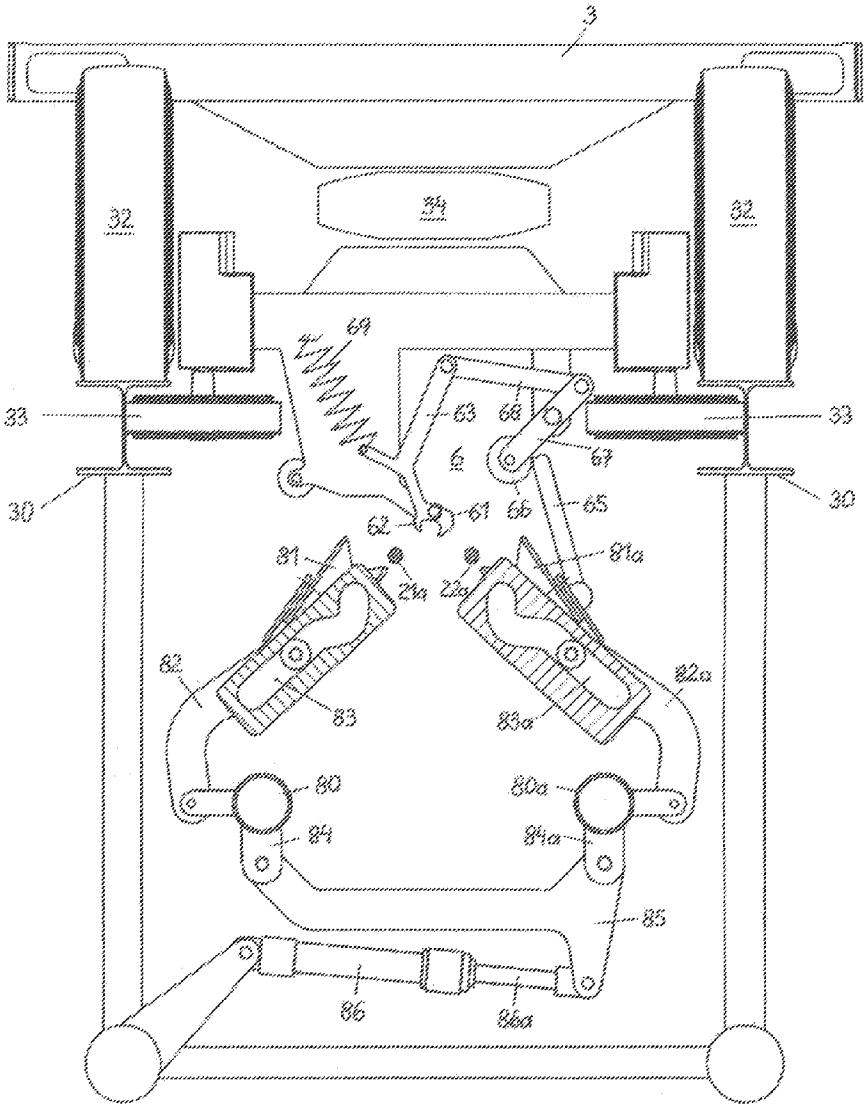
FIG. 5, FIG. 5A, FIG. 5B, FIG. 5C, FIG. 5D and FIG. 5E show a third embodiment of the device for moving the cable runs, in side view and in different phases of the coupling procedure.
Figure 5A:
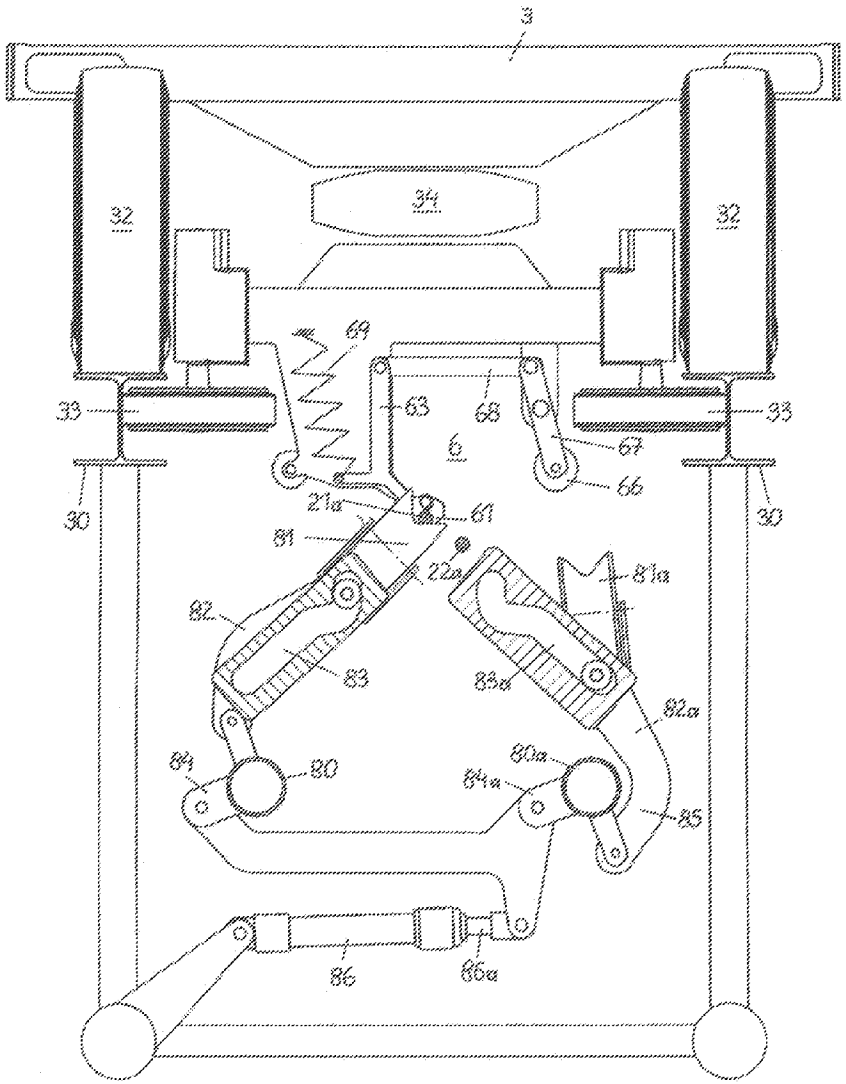
Figure 5B:
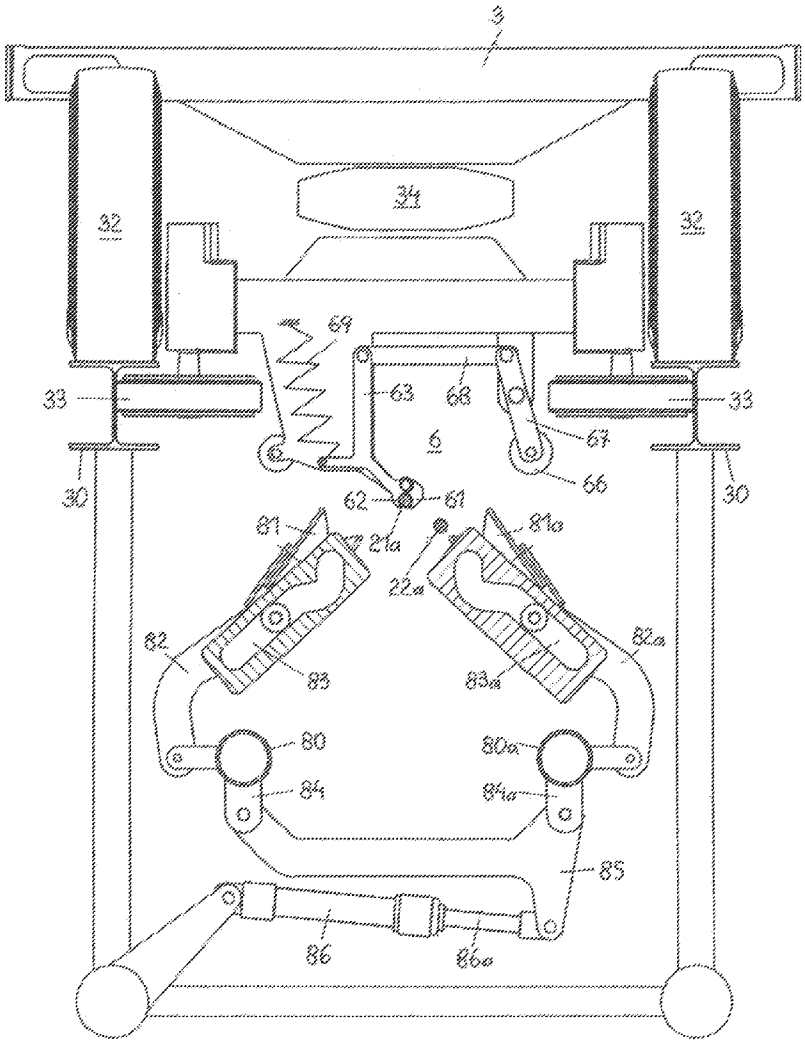
Figure 5C:
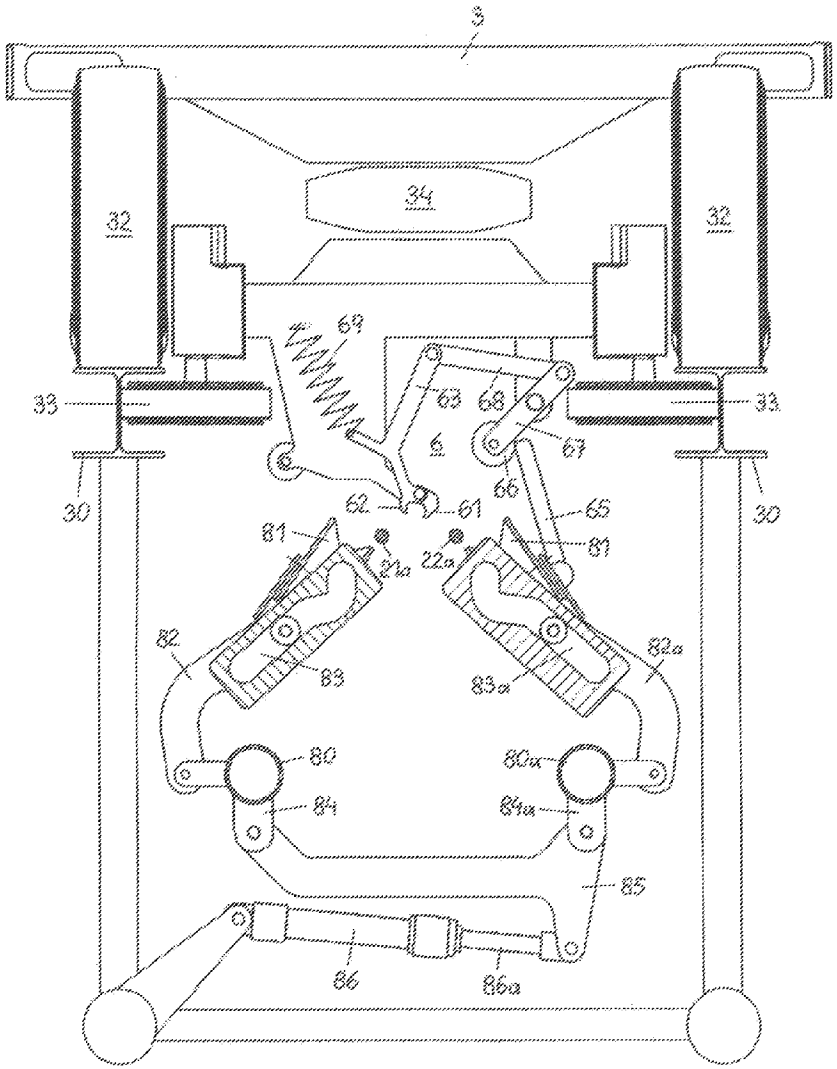
Figure 5D:
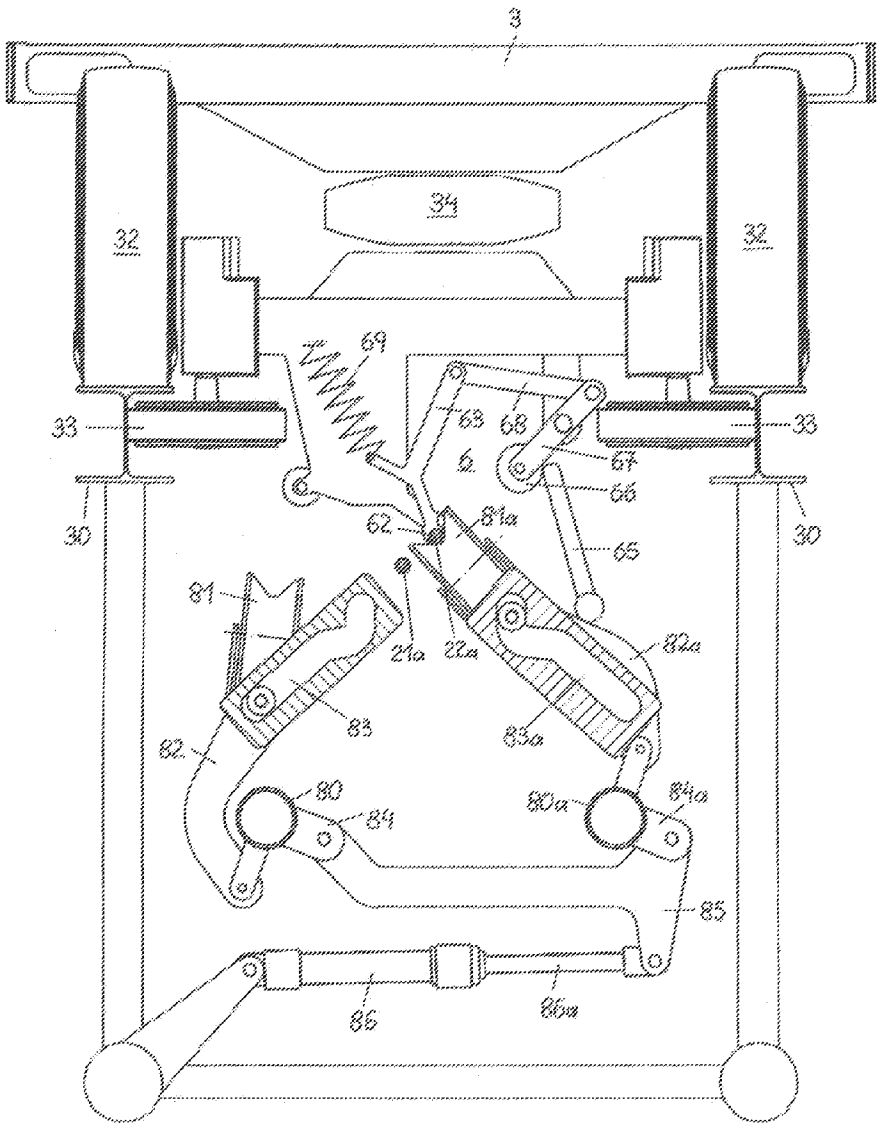
Figure 5E:
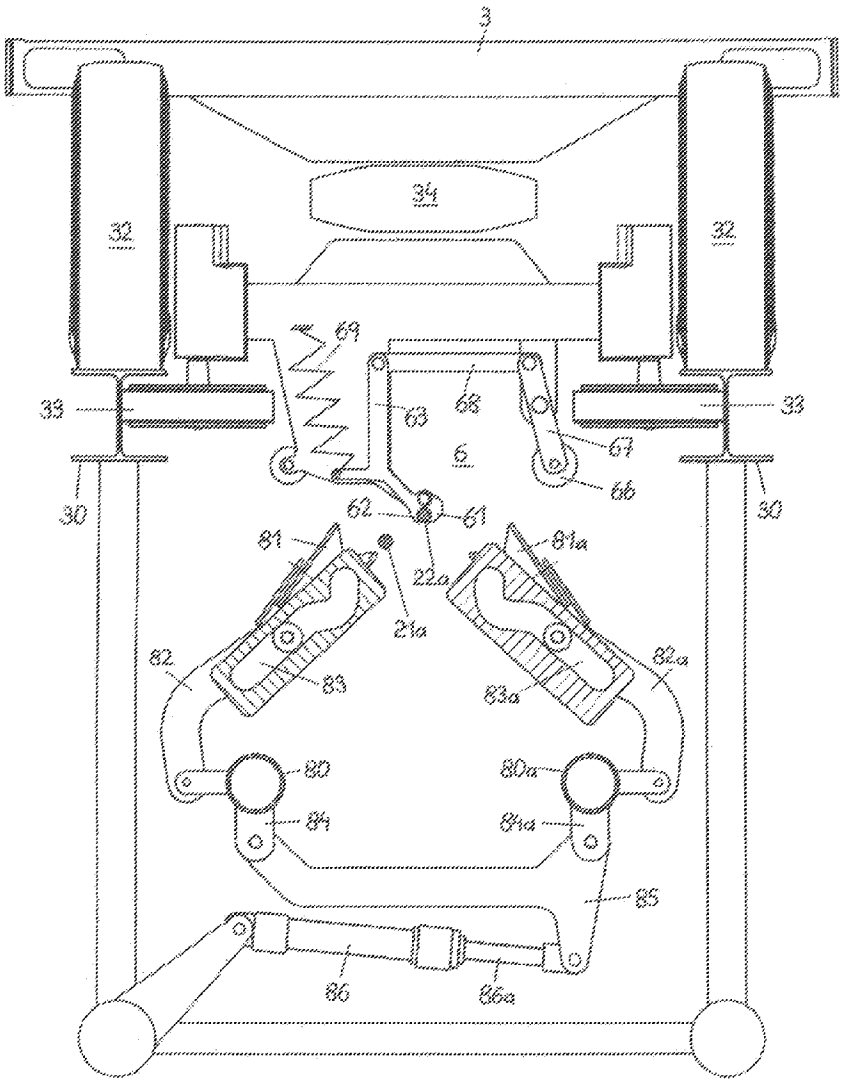

In the third embodiment, which is illustrated by way of FIGS. 5 to 5*e*, of a servo device for the cable runs 21*a* and 22*a*, two movable servo rolls 81 and 81*a* are provided, which are guided in slideways 83 and 83*a* by means of servo levers 82 and 82*a*. The servo levers 82 and 82*a* are articulated to angled levers 84 and 84*a*, which are located on rotatably mounted tubular pieces 80 and 80*a*, as a result of which they are movable in opposite directions by means of a common control lever 85 to which the piston rod 86*a* of a hydraulic or pneumatic servo cylinder 86 is articulated. By moving the control rolls 81 and 81*a*, which are guided in the slideways 83 and 83*a*, the associated cable runs 21*a* and 22*a* may be moved into the clamping device 6, which is in its open position.

In this embodiment too, the clamping devices 6 are operated by means of the servo cylinder 64 illustrated in FIG. 3, which moves the servo roll 66 by way of the servo lever 65, the servo arms 67 and 68 and the servo lever 63.

Instead of the servo cylinder 86, an electric servo motor may be provided.

FIG. 5 illustrates the central position of the two servo rolls 81 and 81*a*, wherein the clamping device 6 is not coupled to either of the two cable runs 21*a* and 22*a*.

As illustrated in FIG. 5A, the servo roll 81 may be moved in the slideway 83 by means of the servo cylinder 86—which retracts the piston rod 86*a*—by way of the control lever 85, the angled lever 84, which is pivoted clockwise, and the servo lever 82 such that the cable run 21*a* is grasped by the servo roll 81 and moved into the clamping jaws 61 and 62, which are in the open position.

As illustrated in FIG. 5B, thereupon the clamping device 6 is put into its closed position, as a result of which the vehicle 3 is clamped to the cable run 21*a*, and the servo roll 81 is moved back into its starting position.

As illustrated in FIG. 5C, the vehicle 3 is uncoupled from the cable run 21*a* again by the clamping device 6 being opened by means of the servo cylinder 64.

As illustrated in FIG. 5D, the servo roll 81*a* may be moved in the slideway 83*a* by means of the servo cylinder 86, the piston rod 86*a*, the control lever 85 and the angled lever 84*a*—which is rotated counterclockwise—and by means of the servo lever 82*a* such that the cable run 22*a* is grasped by the servo roll 81*a* and moved into the clamping device 6, which is in its open position.

As illustrated in FIG. 5E, thereupon the clamping device 6 is put into its closed position, as a result of which the vehicle 3 is coupled to the cable run 22*a*, and the servo roll 81*a* is moved back into its starting position.

Where a plurality of servo devices, spaced from one another in the longitudinal direction of the system, are connected to one another by way of at least one of the tubular pieces 80 and 80*a*, all the servo rolls 81 and 81*a* may be moved by means of a single servo cylinder 86.

The invention claimed is:

1. A system for conveying persons, comprising:

at least one track and a plurality of vehicles to be supported on said at least one track;

a plurality of continuous conveying cables for driving said vehicles along said at least one track, said conveying cables including a first conveying cable and at least one successive conveying cable disposed successively to said first conveying cable and with an overlap region therebetween;

at least one drive associated with each of said successive conveying cables for independently driving each of said conveying cables;

said vehicles each carrying clamping devices configured for clamping said vehicles to respective said conveying cables;

said cables having cable run s overlapping one another in mutually associated end regions thereof to form said overlap region, enabling a coupling of a respective said vehicle to be transferred from said first conveying cable to a successive said conveying cable; and at least one servo device disposed in said overlap region at which said first conveying cable and said successive conveying cable overlap one another, and configured to move the cable run of said successive conveying cable into said clamping device of a vehicle to be coupled, while said clamping device is in an open position.

2. The system according to claim 1, wherein said vehicles have at least one clamping device each, and said clamping device has two clamping jaws movably disposed into an open position by way of a servo cylinder in opposition to an action of a servo spring.

3. The system according to claim 1, wherein said servo device has at least one servo roll disposed to move the cable run of said successive conveying cable to which the vehicle is to be coupled substantially in a horizontal direction and at least one servo roll disposed to move the cable run of said successive conveying cable substantially in a vertical direction.

4. The system according to claim 3, wherein said servo device is configured to move cable runs of said conveying cables substantially horizontally and includes at least one pair of servo rolls disposed to move a respective one of the two cable runs of two conveying cables that are located next to one another substantially in the horizontal direction.

5. The system according to claim 3, wherein said servo device for moving cable runs substantially vertically has at least one servo roll disposed to move a respective one of the two cable runs of two conveying cables that are located next to one another at least approximately in the vertical direction.

6. The system according to claim 3, wherein said servo device for moving cable runs substantially horizontally has a plurality of pairs of servo rolls disposed spaced from one another in a longitudinal direction of the system, and is configured for moving a respective one of the two cable runs of two said conveying cables that are located next to one another substantially in the horizontal direction.

7. The system according to claim 3, wherein said servo device for moving cable runs substantially vertically has a plurality of servo rolls disposed spaced from one another in a longitudinal direction of the system, and is configured for moving a respective one of the two cable runs of two conveying cables that are located next to one another substantially in the vertical direction.

8. The system according to claim 7, which comprises a servo rod extending in a longitudinal direction of the system and disposed to move said servo rolls for moving the cable runs vertically.

9. The system according to claim 3, which comprises a device selected from the group consisting of at least one hydraulic servo cylinder, a pneumatic servo cylinder, and an electric servo motor for moving said servo rolls for moving one of the cable runs substantially in the horizontal or vertical direction.

10. The system according to claim 1, wherein said servo device comprises a servo frame movably disposed for translation by a servo cylinder or a servo motor, said servo frame having two receiving faces for a respective one of two cable runs located next to one another in said overlap region, said receiving faces being capable to grasp one of the two cable runs and move the one cable run into said clamping device while said clamping device is in the open position.

11. The system according to claim 10, wherein said servo cylinder or servo motor has a piston rod articulated to said servo frame, and said servo frame is articulated to two rotatably mounted pivotal arms.

12. The system according to claim 10, wherein said servo frame has two prolonged portions that project toward the cable runs and are formed with a respective shoulder on mutually facing sides, and wherein said shoulders are able to grasp a respective cable run and move the cable run into said clamping device while said clamping device is in the open position.

13. The system according to claim 1, wherein said servo device comprises two servo rolls guided in slideways by way of a servo cylinder or an electric servo motor, wherein a movement thereof allows one of the two cable runs to be grasped and moved into said clamping device while said clamping device is in the open position.

14. The system according to claim 13, wherein said servo rolls are moved by way of a respective servo lever, which is articulated to a rotatably mounted angled lever, and wherein a common servo lever, to which a piston rod of said servo cylinder or said electric servo motor is articulated, is associated with said two angled levers.

15. The system according to claim 14, wherein said two angled levers are each pivotable clockwise and counterclockwise by said servo cylinder or said electric servo motor, wherein one of said two servo rolls are movable toward the associated cable run or away therefrom.

16. The system according to claim 10, wherein said mutually spaced-apart servo devices are connected mechanically to one another for movement together.

* * * * *